US006341692B1

(12) United States Patent
Miller

(10) Patent No.: US 6,341,692 B1
(45) Date of Patent: Jan. 29, 2002

(54) CARTON CARRIER

(76) Inventor: Charles A. Miller, 2339 Harris Ave., Cincinnati, OH (US) 45212

( * ) Notice: Subject to any disclaimer, the term of this patent is extended or adjusted under 35 U.S.C. 154(b) by 0 days.

(21) Appl. No.: 09/642,720

(22) Filed: Aug. 21, 2000

Related U.S. Application Data

(63) Continuation-in-part of application No. 09/237,780, filed on Jan. 26, 1999, now Pat. No. 6,105,773.

(51) Int. Cl.[7] ..... B65D 65/00
(52) U.S. Cl. ..... 206/431; 206/434; 294/87.2
(58) Field of Search ..... 206/427, 431, 206/434; 229/117.14, 120.01; 294/87.2, 87.28

(56) References Cited

U.S. PATENT DOCUMENTS 2,675,264 A * 4/1954 Vander Lugt, Jr. ..... 294/87.2
5,513,753 A * 5/1996 Jensen ..... 206/431

* cited by examiner

*Primary Examiner*—Shian Luong
(74) *Attorney, Agent, or Firm*—A. Ralph Navaro, Jr.; Wood, Herron & Evans, LLP

(57) ABSTRACT

A sleeve style carton carrier for carrying cartons of the type having a gable pocket defined in each of opposing end walls. The carrier has side walls, and end walls that define a sleeve adapted to surround the carton, the end walls each being foldably attached to a latch panel. The latch panels are deformable into the carton's gable pockets when the carrier receives a carton therein. When the carrier and carton assembly is lifted, the latch panels are trapped tightly in the gable pockets under the weight of the carton and its contents.

18 Claims, 7 Drawing Sheets

CARTON CARRIER

This is a continuation-in-part of U.S. patent application Ser. No. 09/237,780 filed Jan. 26, 1999, now U.S. Pat. No. 6,105,773 which is incorporated by reference herein in its entirety.

This invention relates to cartons. More particularly, this invention relates to carton carriers.

Carriers are widely used in the beverage industry to facilitate transporting beverage packaged in cans and bottles that hold soda and beer. Carriers for cans are seen in U.S. Pat. Nos. 5,197,656; and 5,682,984. The can carriers typically surround a can matrix in a box and hold the matrix tightly therein. Carriers that accommodate bottles are seen in U.S. Pat. Nos. 4,319,682; and 4,505,696. These basket carriers generally support bottle weight from below and compartmentalize each bottle held in the basket. Also, bottle carriers as seen in U.S. Pat. Nos. 3,752,305; 3,860,281; and 3,946,862, carry a matrix of bottles by basically engaging a bead or edge around each bottle's neck near the bottle's cap.

Applicant's invention is directed to a carton carrier for traditionally configured paperboard cartons, e.g., with cartons and juice cartons. There is one basic problem associated with the prior art can carriers and bottle carriers which Applicant's invention is intended to overcome. Specifically, none of the prior art carriers are adapted to carry traditionally configured beverage cartons, that is, paperboard cartons for milk or juice, that have a pair of sloping ceiling panels converging to form a ceiling ridge, and a gable pocket being formed below either end of the ridge by opposing side walls folding inward and attaching to the underside of the ceiling panels. Prior art carriers of the type disclosed in the above cited patents simply are unsuitable to carry these cartons.

Accordingly, it has been one objective of this invention to provide a carton carrier adapted for use with gable end cartons of the type traditionally used for milk and juice.

It has been another objective of this invention to provide a carton carrier adapted for use with gable end cartons that grips the carton by its gable end.

It has been a further objective of this invention to provide a carton carrier adapted for use with gable end cartons, the carrier being connected with the carton's gable end so that the connection is enhanced under the influence of the weight of the carton contents as the carton is carried by the carrier's user It has been still a further objective of this invention to provide a carton carrier adapted to hold two gable end cartons located in side by side relation, the carrier cooperating with one gable end of each of the two cartons.

In accord with these objectives, the invention contemplates a carton carrier particularly structured for use with gable end cartons such as paperboard cartons of the traditional type used for milk and juice.

The carton carrier includes, in preferred form, opposed side walls and opposed end walls, in a generally sleeve type configuration, and a carrier handle attached to those carrier walls. The carrier also includes a ceiling attached to the carrier walls. A deformable latch panel is foldably attached to each of the carrier's end walls. Each latch panel is generally triangular in shape. At least one web panel connects the latch panel with the carrier's roof. Each latch panel and web panel is generally coplanar with the associated carrier's end wall.

The carton carrier is adapted to carry cartons having opposed side walls, opposed end walls, and ceiling panels that form a peaked roof above the carton. The end walls are each foldably attached at their respective top edges to a gable panel which is positioned inwardly under and fixed to the carton's ceiling, thereby forming a gable pocket at each end of the carton.

When the carrier is assembled with a carton, the carrier's sleeve slides down over the carton ceiling so that the carton is located in a relatively close fit with that sleeve. The carton is positioned within the carton carrier so that the latch panel generally overlies the carton's gable pocket. A latch force erected generally centrally on the latch panel deforms the latch panel inwardly toward the carton's gable pocket. In other words, as a latch force is erected upon the latch panel to force it to move into the gable pocket, the latch panel and a portion of each web panel cave into the gable pocket. When the carton and its contents is lifted by the carton carrier by its carrier handle, the latch panel and web panels are deformed further inwardly into the gable pocket, i.e., are latched even more firmly in the carton's gable pocket, thereby, effectively automatically locking the carton carrier with the carton under the carton's own weight as the carton is carried by the carton carrier.

Other objectives and advantages of the invention will be more apparent from the following detailed description taken in conjunction with the drawings.

Figure 1:
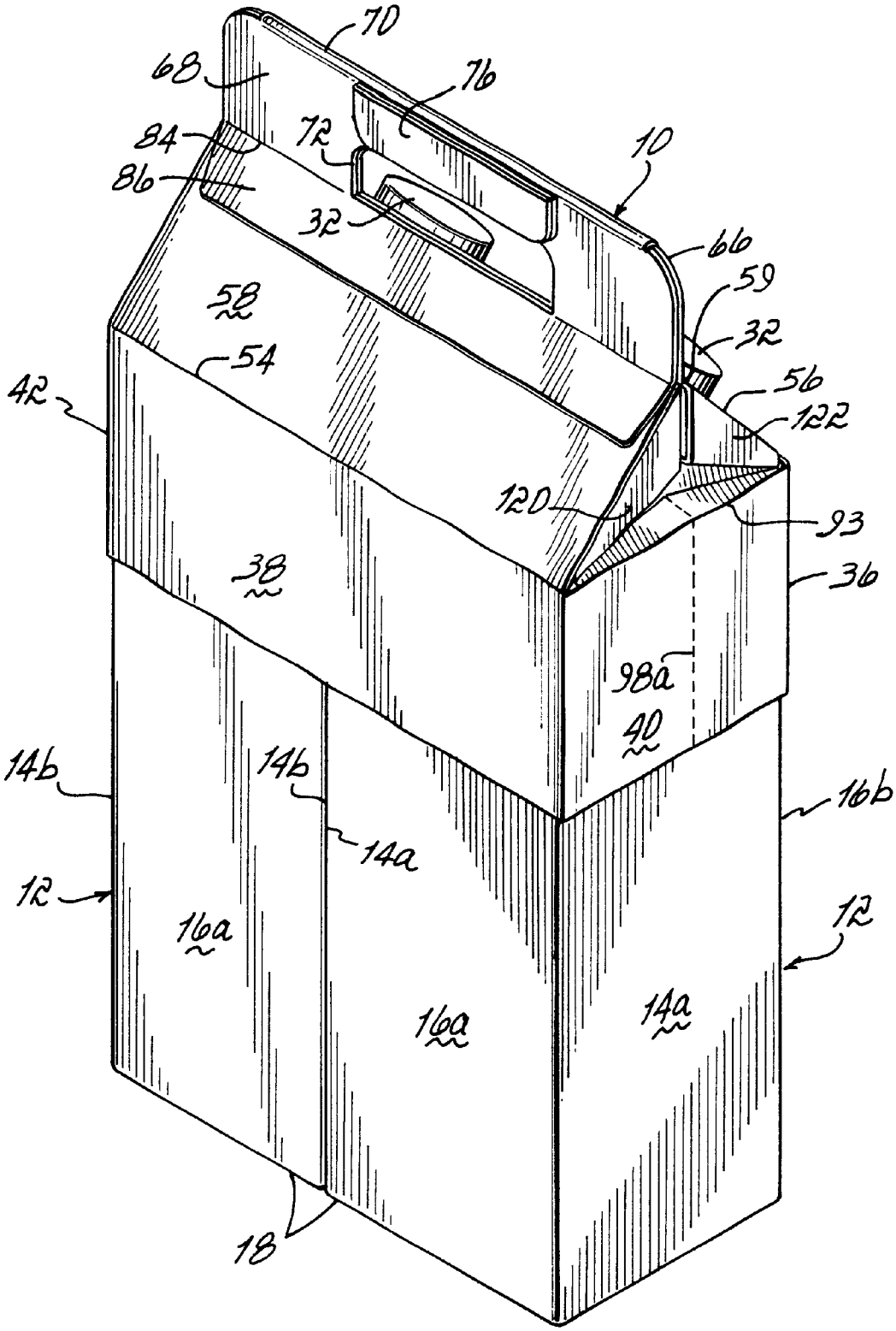
FIG. 1 is a perspective view of a carton carrier in accordance with the principles of the present invention, the same being illustrated in a final assembled form two cartons of the traditional paperboard type.

A carton carrier 10 of this invention is particularly structured for use with juice or milk cartons 12 of the traditional paperboard type illustrated in FIGS. 1 and 5–7. The paperboard carton 12 of this type has opposing end walls 14*a,* 14*b,* opposing side walls 16*a,* 16*b,* a base 18, a ceiling 19 having opposing ceiling panels 20, 22 attached at their bottom margins to the respective top margins of opposing end walls 14*a,* 14*b,* and opposing gable panels 24, 26. The gable panels 24, 26 are attached at their bottom margins to the opposing end walls 14*a,* 14*b.* The ceiling panels 20, 22 are joined along their top margins to form a ceiling ridge 28. The gable panels 24, 26 are folded inwardly and under the ceiling panels 20, 22, and attached to the underside of the ceiling panels 20, 22, to form gable pockets 30. An annular wall (not shown) defines a carton aperture (not shown) in the ceiling panel 20 to form a dispensing spout (not shown). The dispensing spout is sealed by a removable cap 32 so that a user may ultimately use the contents of, and then re-seal the contents within, the carton 12.

Figure 2:
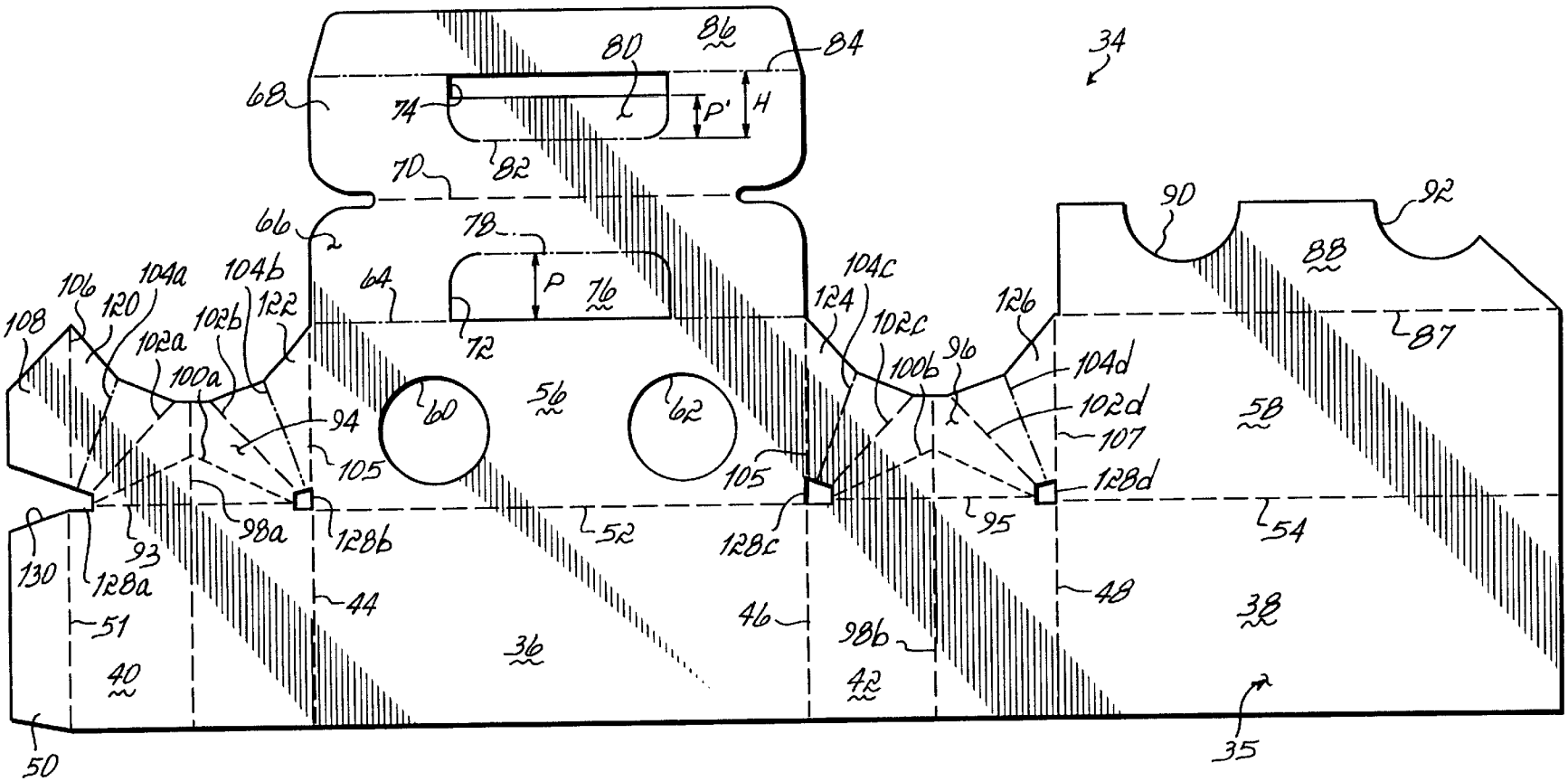
FIG. 2 is a top plan view of a carrier blank for the carton carrier illustrated in FIG. 1.

A carton carrier blank 34 in accord with the principles of this invention is illustrated in FIG. 2. As shown therein, the carrier blank 34 has obverse and reverse side 35, 37 (FIGS. 3 and 4), and comprises first and second side walls 36, 38, first and second end walls 40, 42, and first and second roof panels 56, 58. The first side wall 36 is foldably attached at opposing end margins to first and second end walls 40, 42 by score lines 44, 46 defined in the blank 34. In the preferred embodiment, the second side wall 38 is foldably attached at only one of its end margins to the second end wall 42 by a score line 48 defined in the blank 34. The first end wall 40 is foldably attached at the margin opposite the first side wall 36 to a glue panel 50 by a score line 51. When the carrier blank 34 is erected into the carrier 10, the glue panel 50 is joined with the margin of the second side wall 38 opposite the second end wall 42, see FIG. 3.

Figure 3:
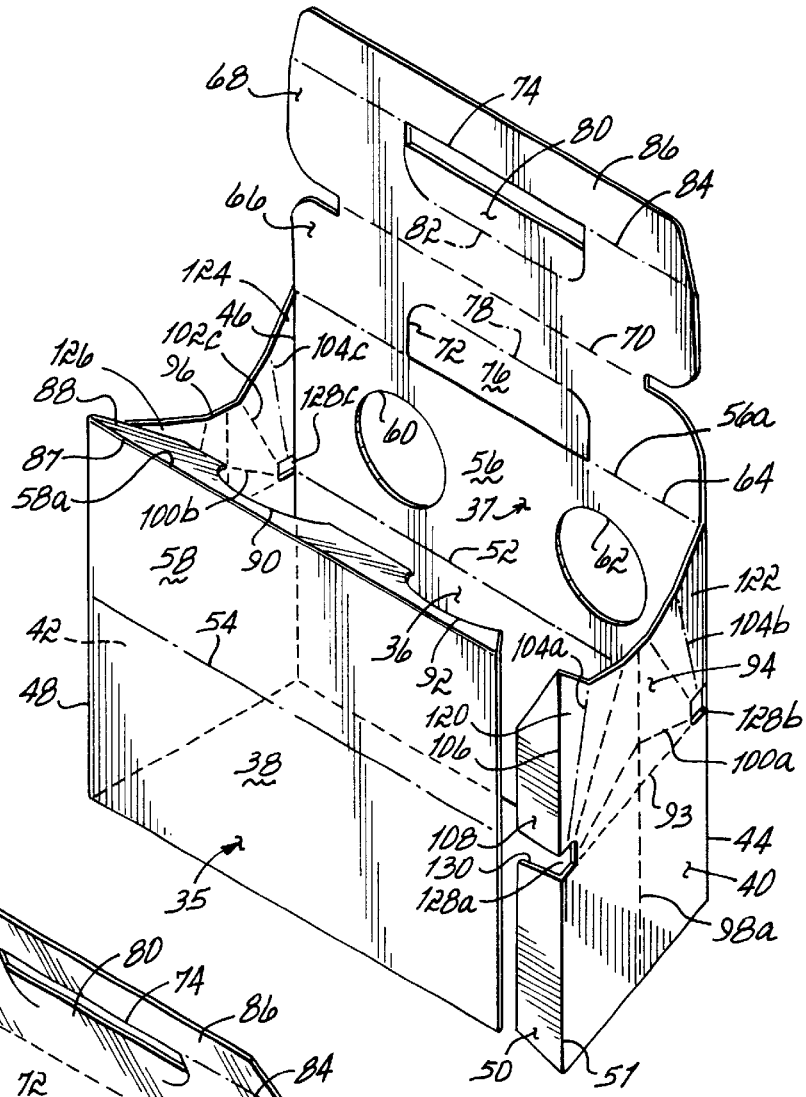
FIG. 3 is a perspective view of the carton carrier in a first intermediate assembled stage.
Figure 4:
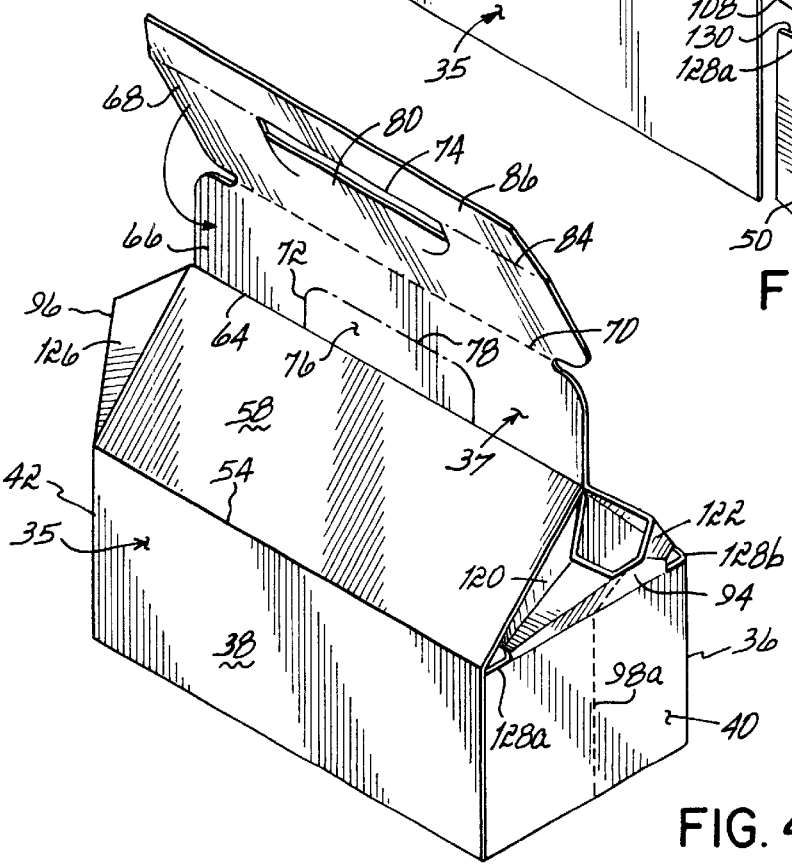
FIG. 4 is a perspective view of the carton carrier in a second intermediate assembled stage.

The first and second side walls 36, 38 are foldably attached by score lines 52, 54 along their respective top margins to first and second roof panels 56, 58. In the preferred embodiment, the first roof panel 56 defines a pair of holes 60, 62 for receiving the carton cap 32 of the carton's dispensing spout therethrough. The first roof panel 56 is joined along its top margin by a fold line 64 to first and second handle panels 66, 68. The first and second handle panels 66, 68 are joined together by a score line 70 along their respective upper margins. The first and second handle panels 66, 68 define first and second finger holes 72, 74, respectively, through which a user may insert fingers to carry an assembled carton carrier 10. Located within the first finger hole 72 is a first finger panel 76 joined by a fold line 78 along its upper margin to the first handle panel 66. Located within the second finger hole 74 is a second finger panel 80 joined by a fold line 82 along its upper margin to the second handle panel 68. In the preferred embodiment, the height P of the first finger panel 76 is substantially equal to the height H of the first finger hole, whereas the height H of the second finger hole 74 is substantially greater than the height P' of the second finger panel 80. The second handle panel 68 is joined with a fold line 84 along its bottom margin to a glue panel 86. When the carrier blank 34 is erected into the carton carrier 10, the reverse side 37 of the glue panel 86 is joined with the obverse 35 side of the second roof panel 58, as seen in FIGS. 3 and 4.

The second roof panel 58 is joined by a score line 87 along the margin opposite the second side wall 38 to a glue panel 88. The glue panel 88 defines a pair of semi-circular cut out areas 90, 92 in the top margin. When the carrier blank 34 is erected into a carrier 10, the obverse side 35 of the glue panel 88 is joined with the reverse side 37 of the first roof panel 56 so that the semi-circular cut out regions 90, 92 underlie the respective holes 62, 60 defined in the first roof panel 56.

First and second latch panels 94, 96 are joined to the top margin of first and second end walls 40, 42 by respective score lines 93, 95. Each latch panel 94, 96 which is generally triangular configuration is generally vertically bisected with respective score lines 98*a,* 98*b*. Also, each latch panel 94, 96 has respective obtuse score line 100*a,* 100*b* defined therein, the apex of the score lines 100*a,* 100*b* being located generally medially along the vertical score lines 98*a,* 98*b*. In the preferred embodiment, each latch panel 94, 96 is joined by respective score lines 102*a,* 102*b* and 102*c,* 102*d* to a pair of web panels 120, 122, and 124, 126, respectively. Each web panel 120, 122, and 124, 126 is generally bisected by respective fold lines 104*a,* 104*b,* and 104*c,* 104*d*.

In the preferred embodiment, the carrier's roof panel 56 is joined to web panels 122, 124 by score line 105 so as to join that roof panel 56 to the latch panels 94, 96. The web panel 120 is joined by a score line 106 along the margin opposite the first latch panel 94 to a glue panel 108, and the latch panel 96 is joined by a score line 107 to the roof panel 58 so as to also join the roof panel 58 to the latch panels 94, 96 when the carrier is erected (FIG. 3). When the carrier blank 34 is formed into the carrier 10, the obverse side 35 of the glue panel 108 is joined with the reverse side 37 of the second roof panel 58 (See FIG. 3).

Figure 5:
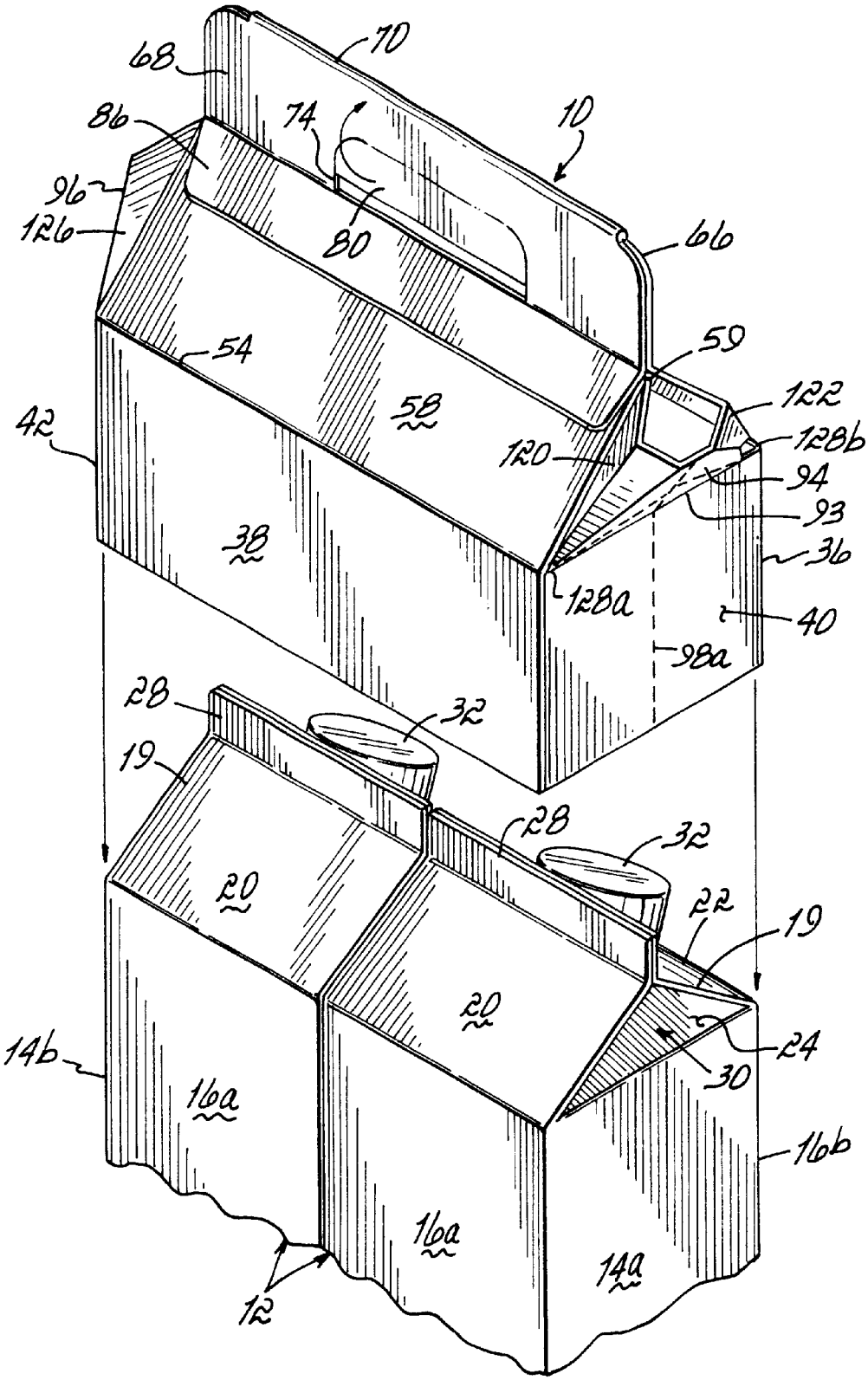
FIG. 5 is a perspective view of a certain carrier positioned above a pair of cartons prior to receiving and locking the cartons in assembly with the carrier.

In the preferred embodiment, when the carrier blank 34 is formed into the carrier 10, the carrier 10 defines first, second, third and fourth corner holes 128*a,* 128*b,* 128*c,* 128*d,* as seen in FIGS. 2 and 5, that function as areas of stress relief when the first and second latch panels 94, 96, and first, second, third and fourth web panels 120, 122, 124, 126 are deformed inwardly, as discussed further below. As seen in FIG. 2, before the carrier blank 34 is assembled into the carrier 10, the first corner hole 128*a* is simply a portion of a gap 130 defined in the carton blank 34 prior to the time when the glue panels 50, 108 are glued to the second side wall 38 and second roof panel 58, respectively.

Figure 6:
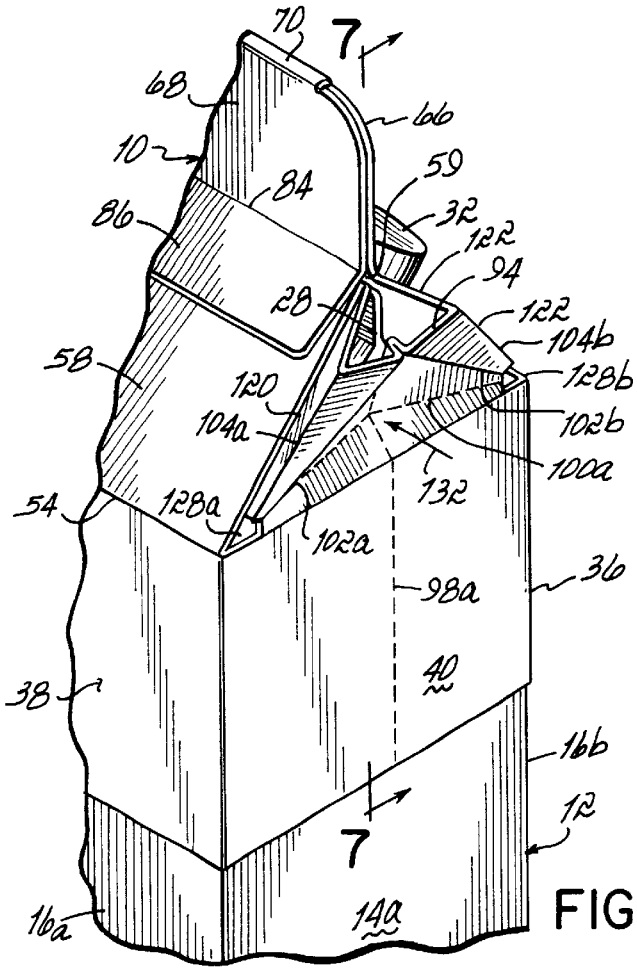
FIG. 6 is a partial perspective view of the carton carrier fitted to a carton, the carrier being in an intermediate stage of locking to the carton.

Assembly of the carrier blank 34 of this invention is illustrated in FIGS. 3 to 7. First, the second side wall 38 and second roof panel 58 are glued to the glue panels 50, 108, respectively, thus providing the carrier 10 with its sleeve configuration as shown in FIGS. 1 and 6. Next, the glue panel 88 is attached to the reverse side of the first roof panel 56 so that the pair of semicircles 90, 92 substantially underlie the pair of holes 60, 62, respectively in the first roof panel 56 and so that adjacent upper edges 56*a,* 58*a* of the first and second roof panels 56, 58, respectively, are joined together to form a carrier ridge line 59. The second handle panel 68 is then folded over the first handle panel 66 so that the glue panel 88 can be secured to the second roof panel 58. Note particularly that, as the glue panel 88 is joined with the first roof panel 56, the first and second latch panels 94, 96 with the first and second 120, 122, and third and fourth 124, 126 web panels, respectively, attached thereto, are bowed outwardly (see FIG. 4) relative to the respective planes defined by the first and second end walls 40, 42 when the carton carrier 10 is erected from the carrier blank 34 but not yet latched with the cartons 12 (see FIG. 5) to allow for insertion of the carton 12 into the carton carrier 10.

The assembled carton carrier 10 is then fitted down over a pair of side by side cartons 12 so that the cap 32 on each respective carton 12 is received through the respective carton carrier roof holes.

Figure 7:
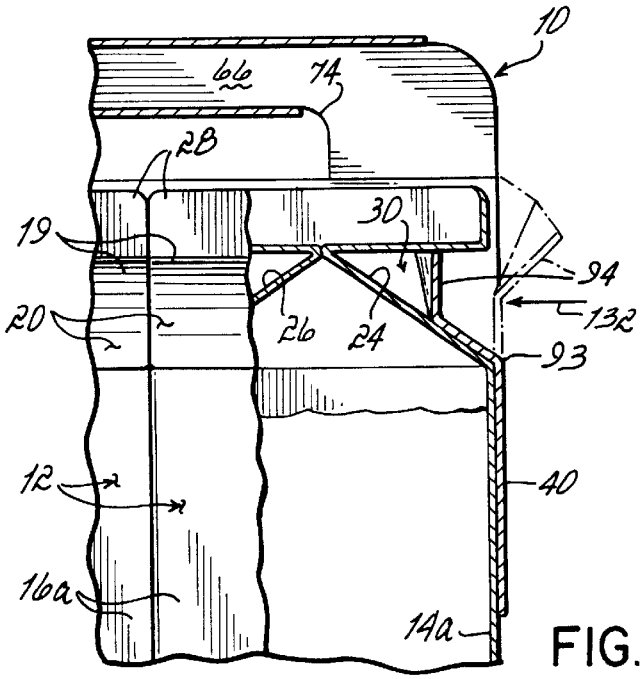
FIG. 7 is a partial cross-sectional view of FIG. 6 taken along line 7–7 of FIG. 6, showing the lock panel in a lock position.

In order to latch the carton carrier 10 to the cartons 12, a force, as indicated by the directional arrow 132 in FIGS. 6 and 7, is directed inwardly against the latch panel 94 at a point near the intersection of the vertical score line 98*a* and the obtuse score line 100*a*. The force 130 erected upon the latch panel 98*a* collapses it inwardly into the gable pocket 30. Also, in the preferred embodiment, the web panels 120, 122 simultaneously tuck inwardly and under the carton ceiling panels 20, 22.

Figure 8:
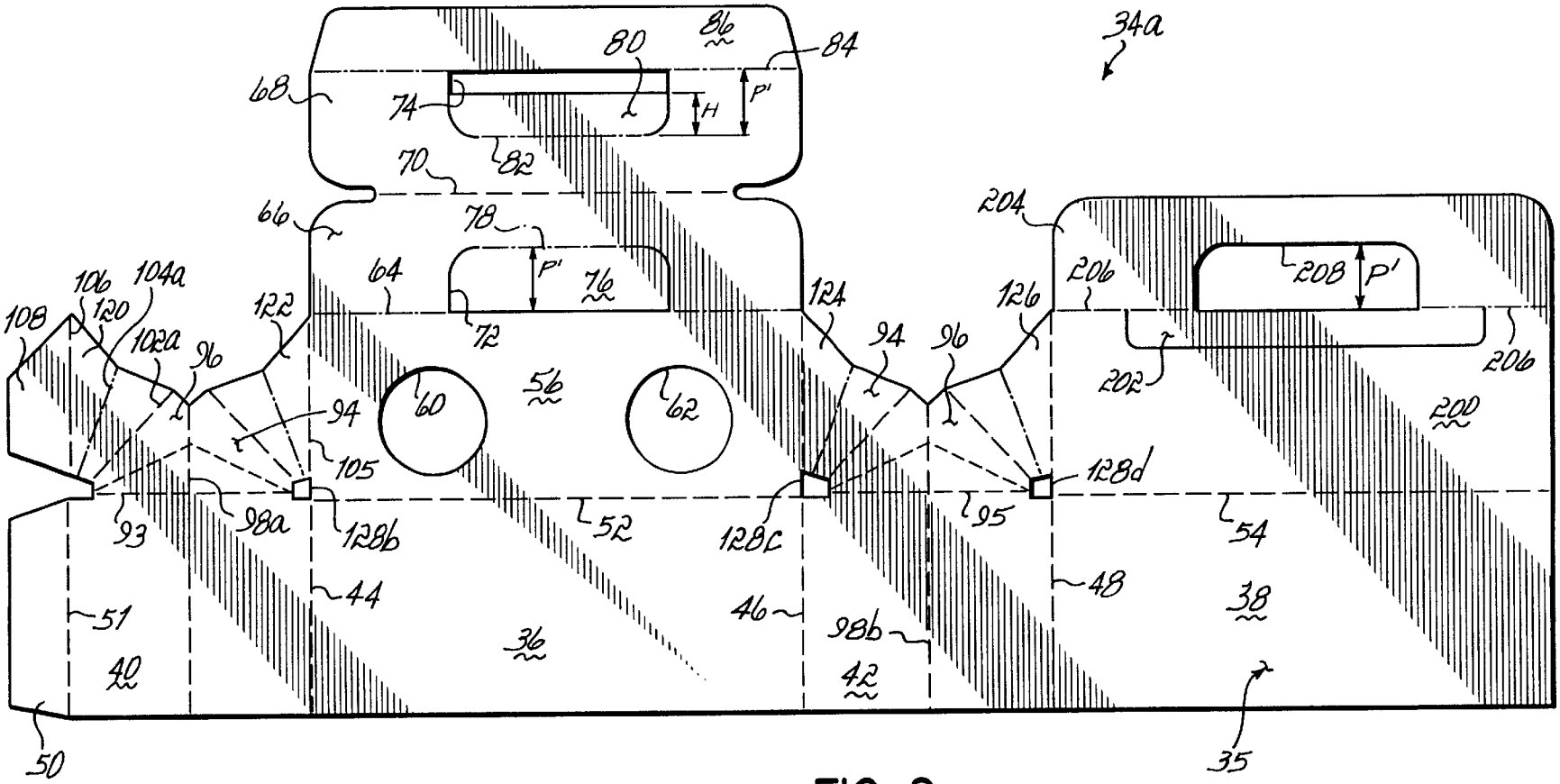
FIG. 8 is a view similar to FIG. 2 showing an alternative embodiment of the present inventive carton carrier.
Figure 9:
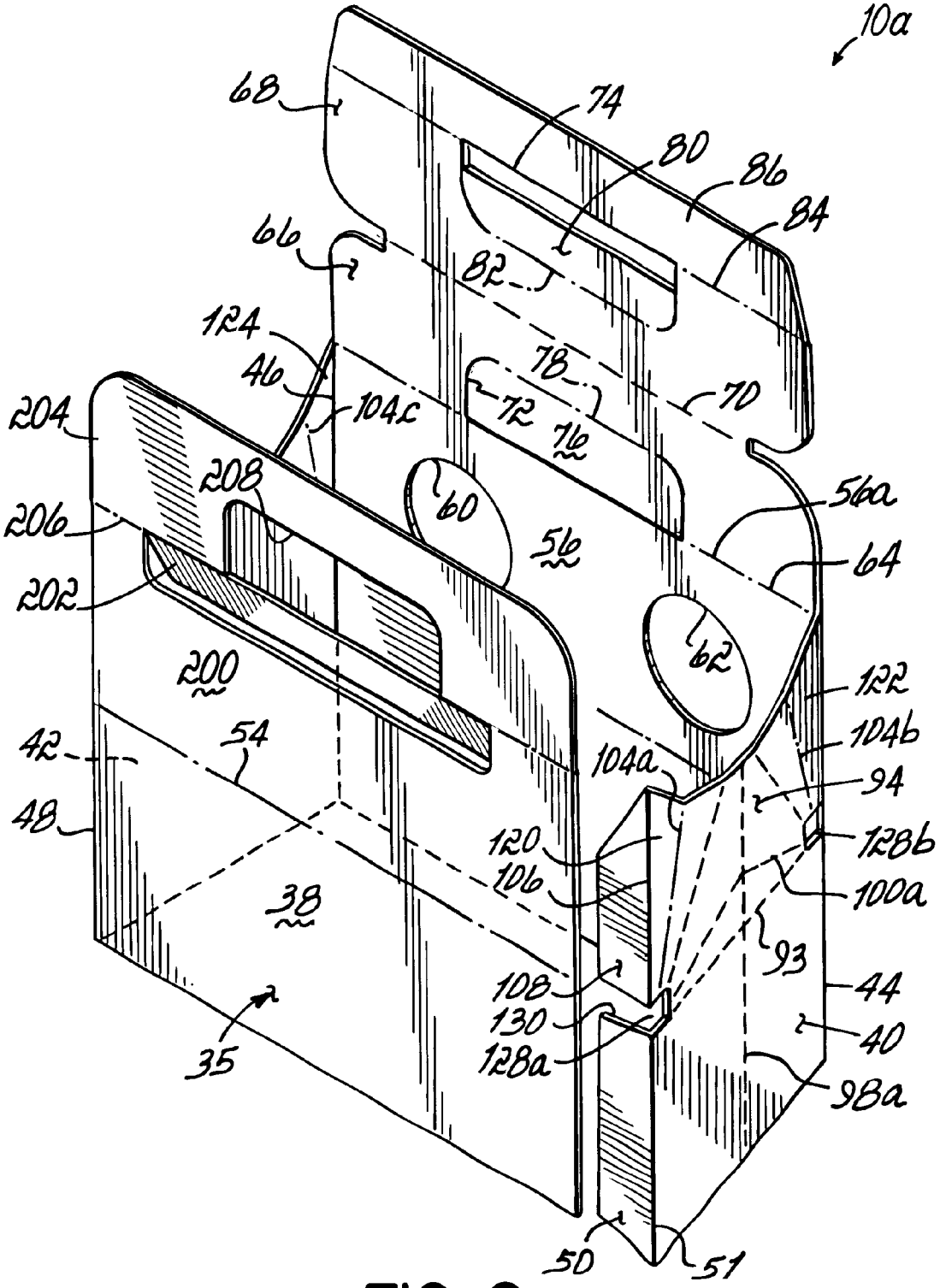
FIG. 9 is a view of the carton carrier of FIG. 8 in a first intermediate assembled stage.

An alternative embodiment of a carton carrier 10*a* and carton carrier blank 34*a* is seen in FIGS. 8 and 9 in which like reference numerals indicate like elements corresponding with the carton carrier 10, described above. The carton carrier 10*a* includes a second roof panel 200 which defines a glue panel 202 received against and glued to the reverse side 37 of the first roof panel 56 to prevent the ceiling ridge 28 of carton 12 (FIG. 1) from wedging between and separating the first and second handle panels 66, 68 from each other after the carton carrier 10*a* has been fully assembled.

A third handle panel 204 is foldably attached to the second roof panel 200 by score line 206. The glue panel 202 is foldably attached to the third handle panel 204 by score line 206. The third handle panel 204 defines a third finger hole 208 through which a user may insert fingers to facilitate carrying the carton carrier 10*a* with cartons 12 inserted therein.

As seen in FIG. 8, the third finger hole 208 has height P' substantially equal to the height P' of the first and second finger holes 72,74. During assembly, the third handle panel 204 is securely sandwiched and preferably glued between the first and second handle panels 66, 68 so that the third finger hole 208 is aligned with the first and second finger holes 72, 74. The third handle panel 204 provides further reinforcement and strength to the carton carrier 10*a* when fully assembled, for carrying cartons 12.

From the above disclosure of the detailed description of the present invention and the preceding summary of the preferred embodiment, those skilled in the art will comprehend the various modifications to which the present invention is susceptible. Therefore, I desire to be limited only by the scope of the following claims and equivalents thereof.

I claim:

1. A carton carrier for a carton, said carton being of the type having a gabled end, a ceiling having opposed ceiling panels converging to form a carton ceiling ridge, and a gable panel attached to said ceiling and cooperating therewith to form a gable pocket, said carrier comprising:

opposing end and side walls joined to form a sleeve adapted to surround said carton when said carrier is assembled with said carton, first and second roof panels integral with respective opposed side walls of said sleeve, said first and second roof panels being joined one to the other at the adjacent edges of said first and second roof panels in order to maintain said first and second roof panels in fixed relation one with the other at a carrier ridge line, a latch panel connected to at least one of said end walls, said latch panel being deformable inwardly into latching engagement with said carton's gabled end so as to latch said carton in assembled relation with said carrier when said carrier is assembled with said carton, thereby permitting said carton to be carried by a user by gripping said carrier after assembly of said carrier with said carton, first and second handle panels foldably attached one to the other, one of said first and second handle panels being foldably attached to one of said first and second roof panels, and a third handle panel foldably attached to the other of said first and second roof panels.

2. The carton carrier of claim 1, wherein said third handle panel is sandwiched between said first and second handle panels.

3. The carton carrier of claim 1, comprising a glue panel foldably attached to said third handle panel to be glued to one of said first and second roof panels.

4. A carton carrier for a carton, said carton being of the type having a gabled end, a ceiling having opposed ceiling panels converging to form a ceiling ridge, and a gable panel attached to said ceiling and cooperating therewith to form a gable pocket, said carrier comprising:

opposing end and side walls joined to form a sleeve adapted to surround said carton when said carrier is assembled with said carton, first and second roof panels integral with respective opposed side walls of said sleeve, first and second handle panels foldably attached one to other, one of said first and second handle panels being foldably attached to one of said first and second roof panels, a glue panel foldably attached to the other of said first and second handle panels, said glue panel being attached to the other of said first and second roof panels to maintain said first and second roof panels in fixed relation to each other at a carrier ridge line, a latch panel connected to at least one of said end walls, and also connected to each of said first and second roof panels, said latch panel being bowed outwardly relative to the said end wall with which said latch panel is connected when said carrier is erected and ready for assembly with said carton but not yet assembled with said carton, and said latch panel being deformable inwardly relative to that carrier's end wall into latching engagement with said carton's gabled end so as to latch said carton in assembled relation with said carrier when said carrier is assembled with said carton, thereby permitting said carton to be carried by a user by gripping said carrier after assembly of said carrier with said carton, and a third handle panel foldably attached to the other of said first and second roof panels.

5. The carton carrier of claim 4, wherein said third handle panel is sandwiched between said first and second handle panels.

6. The carton carrier of claim 4, comprising a glue panel foldably attached to said third handle panel to be glued to one of said first and second roof panels.

7. A carton carrier for a carton, said carton being of the type having a gabled end, a ceiling having opposed ceiling panels converging to form a ceiling ridge, and a gable panel attached to said ceiling and cooperating therewith to form a gable pocket, said carrier comprising:

opposing end and side walls joined to form a sleeve adapted to surround said carton when said carrier is assembled with said carton, first and second roof panels integral with respective opposed side walls of said sleeve, said first and second roof panels being joined one to the other at the adjacent edges of said first and second roof panels in order to maintain said first and second roof panels in fixed relation to each other at a carrier ridge line, a latch panel connected to at least one of said end walls, and also connected to each of said first and second roof panels, said latch panel being bowed outwardly relative to that carrier's end wall with which said latch panel is connected when said carrier is erected and ready for assembly with said carton but not yet assembled with said carton, and said latch panel being deformable inwardly relative to that carrier's end wall into latching engagement with said carton's gabled end so as to latch said carton in assembled relation with said carrier when said carrier is assembled with said carton, thereby permitting said carton to be carried by a user only by gripping said carrier after assembly of said carrier with said carton, first and second handle panels foldably attached one to the other, one of said first and second handle panels being foldably attached to one of said first and second roof panels, and a third handle panel foldably attached to the other of said first and second roof panels.

8. The carton carrier of claim 7, wherein said third handle panel is sandwiched between said first and second handle panels.

9. The carton carrier of claim 8, comprising a glue panel foldably attached to said third handle panel to be glued to one of said first and second roof panels.

10. A carton carrier blank for a carton carrier adapted to carry a carton, said carton being of the type having a gabled end, a ceiling having opposed ceiling panels converging to form a carton ceiling ridge, and a gable panel attached to said ceiling and cooperating therewith to form a gable pocket, said carrier comprising:

opposing end and side walls foldably joined and adapted to form a sleeve that surrounds said carton when said carrier is erected from said blank, first and second roof panels integral with respective opposed side walls of said blank, said first and second roof panels adapted to be joined one to the other at the adjacent edges of said first and second roof panels in order to maintain said first and second roof panels in fixed relation one with the other at a carrier ridge line when said carrier is erected from said blank, a latch panel foldably connected to at least one of said end walls, said latch panel being deformable inwardly and into latching engagement with said carton's gabled end so as to latch said carton in assembled relation with said carrier when said carrier is erected from said blank and said carton assembled therewith, thereby permitting said carton to be carried by a user by gripping said carrier after assembly of said carrier with said carton after said carrier has been erected from said blank, first and second handle panels foldably attached one to the other, one of said first and second handle panels being foldably attached to one of said first and second roof panels, and a third handle panel foldably attached to the other of said first and second roof panels.

11. The carton carrier blank of claim 10, wherein said third handle panel is sandwiched between said first and second handle panels.

12. The carton carrier blank of claim 10, comprising a glue panel foldably attached to said third handle panel to be glued to one of said first and second roof panels.

13. A carton carrier blank for a carton carrier adapted to carry a carton, said carton being of the type having a gabled end, a ceiling having opposed ceiling panels converging to form a ceiling ridge, and a gable panel attached to said ceiling and cooperating therewith to form a gable pocket, said carrier comprising:

opposing end and side walls foldably joined and adapted to form a sleeve that surrounds said carton when said carrier is erected from said blank, first and second roof panels integral with respective opposed side walls of said blank, first and second handle panels foldably attached one to other, one of said first and second handle panels being foldably attached to one of said first and second roof panels, a glue panel foldably attached to the other of said first and second handle panels, said glue panel being attached to the other of said first and second roof panels to maintain said first and second roof panels in fixed relation to each other at a carrier ridge line when said blank is erected into said carrier, a latch panel foldably connected to at least one of said end walls, and also foldably connected to each of said first and second roof panels, said latch panel being bowed outwardly relative to said end wall with which said latch panel is connected when said carrier blank is erected into said carrier and ready for assembly with said carton but not yet assembled with said carton, and said latch panel being deformable inwardly relative to that carrier blank's end wall into latching engagement with said carton's gabled end so as to latch said carton in assembled relation with said erected carrier when said carrier blank is erected into said carrier and said carrier is assembled with said carton, thereby permitting said carton to be carried by a user by gripping said carrier blank after assembly of said erected carrier with said carton after said carrier has been erected from said blank, and a third handle panel foldably attached to the other of said first and second roof panels.

14. The carton carrier blank of claim 13, wherein said third handle panel is sandwiched between said first and second handle panels.

15. The carton carrier blank of claim 13, comprising a glue panel foldably attached to said third handle panel to be glued to one of said first and second roof panels.

16. A carton carrier blank for a carton carrier adapted to carry a carton, said carton being of the type having a gabled end, a ceiling having opposed ceiling panels converging to form a ceiling ridge, and a gable panel attached to said ceiling and cooperating therewith to form a gable pocket, said carrier comprising:

opposing end and side walls foldably joined and adapted to form a sleeve that surrounds said carton when said carrier is erected from said blank, first and second roof panels integral with respective opposed side walls of said blank, said first and second roof panels adapted to be joined one to the other at the adjacent edges of said first and second roof panels in order to maintain said first and second roof panels in fixed relation one with the other at a carrier ridge line when said carrier is erected from said blank, a latch panel foldably connected to at least one of said end walls, and also foldably connected to each of said first and second roof panels, said latch panel bowed outwardly relative to said end wall with which said latch panel is connected when said carrier blank is erected into said carrier and ready for assembly with said carton but not yet assembled with said carton, and said latch panel being deformable inwardly relative to that carrier blank's end wall into latching engagement with said carton's gabled end so as to latch said carton in assembled relation with said erected carrier when said carrier blank is erected into said carrier and said carrier is assembled with said carton, thereby permitting said carton to be carried by a user by gripping said carrier blank after assembly of said erected carrier with said carton after said carrier has been erected from said blank, first and second handle panels foldably attached one to the other, one of said first and second handle panels being foldably attached to one of said first and second roof panels, and a third handle panel foldably attached to the other of said first and second roof panels.

17. The carton carrier blank of claim 16, wherein said third handle panel is sandwiched between said first and second handle panels.

18. The carton carrier blank of claim 16, comprising a glue panel foldably attached to said third handle panel to be glued to one of said first and second roof panels.

* * * * *